US011547192B2

(12) United States Patent
Scalzini

(10) Patent No.: US 11,547,192 B2
(45) Date of Patent: Jan. 10, 2023

(54) BAG ORGANIZER SYSTEMS AND METHODS OF ASSEMBLY

(71) Applicant: Renee Boncore Scalzini, Atlanta, GA (US)

(72) Inventor: Renee Boncore Scalzini, Atlanta, GA (US)

( * ) Notice: Subject to any disclaimer, the term of this patent is extended or adjusted under 35 U.S.C. 154(b) by 347 days.

(21) Appl. No.: 16/802,204

(22) Filed: Feb. 26, 2020

(65) Prior Publication Data

US 2020/0352297 A1 Nov. 12, 2020

Related U.S. Application Data

(60) Provisional application No. 62/901,141, filed on Sep. 16, 2019, provisional application No. 62/845,430, filed on May 9, 2019.

(51) Int. Cl.

| | |
|---|---|
| ***A45C 13/02*** | (2006.01) |
| ***A45C 3/06*** | (2006.01) |
| ***A45C 3/00*** | (2006.01) |
| ***A45C 11/00*** | (2006.01) |

(52) U.S. Cl.

CPC ..... *A45C 13/02* (2013.01); *A45C 3/001* (2013.01); *A45C 3/06* (2013.01); *A45C 2011/002* (2013.01); *A45C 2011/003* (2013.01)

(58) Field of Classification Search

CPC ..... A45C 13/02; A45C 3/001; A45C 3/06; A45C 2011/002; A45C 2011/003

See application file for complete search history.

(56) References Cited

U.S. PATENT DOCUMENTS

| | | | | | |
|---|---|---|---|---|---|
| 1,730,603 | A | * | 10/1929 | Carlson | A45C 3/04 383/4 |
| 1,919,262 | A | | 7/1933 | Shields | |
| 2,183,428 | A | | 12/1939 | Mcnary | |
| 2,455,079 | A | * | 11/1948 | Mercer | A45C 11/04 D3/265 |
| 2,499,332 | A | | 2/1950 | Rose | |
| 2,634,018 | A | | 4/1953 | Mageau, Jr. | |
| 2,710,036 | A | * | 6/1955 | Marks | A45C 3/00 383/97 |

(Continued)

FOREIGN PATENT DOCUMENTS

| | | | |
|---|---|---|---|
| JP | 3207245 | B2 | 5/1992 |
| JP | 3207246 | U | 11/2016 |

*Primary Examiner* — Tri M Mai

(74) *Attorney, Agent, or Firm* — Meunier Carlin & Curfman LLC

(57) ABSTRACT

Various implementations include a bag organizer system that includes at least one pocket disposed within a bag cavity and is coupled to a fixed surface within the bag cavity. The pocket includes at least one pocket side wall having a first edge and a second edge opposite the first edge along a longitudinal axis of the pocket. The first and second edges of the pocket side wall at least partially define an opening to a pocket cavity defined by the pocket side wall and a closed end of the pocket cavity, respectively. The pocket is expandable and collapsible, and the pocket is coupled to the fixed surface by a single seam extending substantially parallel to the longitudinal axis of the pocket, and the closed end of the pocket is not coupled to the fixed surface such that the pocket is hingedly coupled to the fixed surface via the single seam.

18 Claims, 5 Drawing Sheets

(56) References Cited

U.S. PATENT DOCUMENTS

| | | | | | |
|---|---|---|---|---|---|
| 2,710,685 | A | | 6/1955 | Baratelli | |
| 2,903,125 | A | * | 9/1959 | Levoy | A45C 11/04 206/5 |
| 3,070,141 | A | | 12/1962 | Lowy | |
| 3,144,127 | A | | 8/1964 | William | |
| 4,161,201 | A | | 7/1979 | Carp | |
| 4,192,365 | A | | 3/1980 | Siegel | |
| 4,257,463 | A | | 3/1981 | Monaco | |
| 4,401,245 | A | * | 8/1983 | Zills | B65D 81/3897 224/148.6 |
| 4,609,084 | A | | 9/1986 | Thomas | |
| 4,867,215 | A | | 9/1989 | Macieowitz | |
| 4,887,751 | A | | 12/1989 | Lehman | |
| 4,951,811 | A | | 8/1990 | Lines | |
| 5,016,749 | A | | 5/1991 | Kaye et al. | |
| 5,046,860 | A | * | 9/1991 | Brennan | A45C 3/04 D34/1 |
| 5,299,682 | A | | 4/1994 | Tatar | |
| 5,310,048 | A | * | 5/1994 | Stechler | B65D 85/30 206/5 |
| 5,706,935 | A | | 1/1998 | Lorton | |
| 5,749,447 | A | | 5/1998 | Hersh et al. | |
| 6,283,183 | B1 | | 9/2001 | Cooper | |
| 6,945,293 | B1 | | 9/2005 | Newton | |
| 2007/0044877 | A1 | | 3/2007 | Davidoff et al. | |
| 2008/0223493 | A1 | | 9/2008 | Borrelli et al. | |

* cited by examiner

BAG ORGANIZER SYSTEMS AND METHODS OF ASSEMBLY

CROSS REFERENCE TO RELATED APPLICATIONS

This application claims priority to U.S. Patent Application No. 62/845,430, filed May 9, 2019, and U.S. Patent Application No. 62/901,141, filed Sep. 16, 2019, the contents of which are incorporated by reference herein in their entireties.

BACKGROUND

When traveling, people may wish to carry certain items with them. For most people these items include a mobile phone, identification (e.g., driver's license, government ID card, or passport), credit card(s), keys, eyewear (e.g., sunglasses and/or eyeglasses), and lip wear (e.g., lipstick and/or lip balm). Typically, bags are used to carry these items. Bags may include a handbag (or "purse"), travel bag, backpack, tote bag, beach bag, carry-on bag, suitcase, overnight bag, "man-purse" (also known as a "murse"), etc.

Some bags include built-in pockets and/or elastic bands. The pockets are typically formed by sewing fabric to the front or back inner panel of a bag with two side seams and a bottom seam. The side seams are spaced apart from each other, and the bottom seam runs perpendicular between the side seams. An opening to the pocket is defined between the side seams, the pocket material, and the liner and is above the bottom seam. Although these pockets may be sized to receive eyewear, the fabric material does not protect the eyewear from being crushed or damaged by other objects in the bag.

Other bags may include removable organizers that include a main panel and define multiple pockets attached to the main panel, but these removable organizers are not secured to the bag, making them susceptible to shifting within the bag during travel. In addition, the removable organizers do not have pockets that provide sufficient protection for eyewear.

Thus, there is a need in the art for an improved bag organizer system.

BRIEF SUMMARY

Various implementations are directed to a bag organizer system that includes a bag and at least one pocket. The bag has at least one bag side wall, wherein the at least one bag side wall at least partially defines a bag cavity, and a first edge of the at least one bag side wall at least partially defines an opening to the bag cavity. The at least one pocket is disposed within the bag cavity and is fixedly coupled to a fixed surface within the bag cavity. The pocket includes at least one pocket side wall having a first edge and a second edge that is opposite the first edge along a longitudinal axis of the pocket. The at least one pocket side wall at least partially defines a pocket cavity, the first edge of the pocket side wall at least partially defines an opening to the pocket cavity, and the second edge of the pocket side wall at least partially defines a closed end of the pocket cavity. The first edge of the pocket side wall is closer to the bag opening than the second edge of the pocket side wall. In addition, the pocket is expandable and collapsible. A length of the pocket as measured in the direction of the pocket longitudinal axis is greater than a greatest width and/or depth of the pocket when expanded. The width and depth are measured in directions perpendicular to the longitudinal axis and in the same plane, and the width and depth of the pocket are less than a width and a depth of the bag, respectively. In addition, the pocket is coupled to the fixed surface by a single seam extending substantially parallel to the longitudinal axis of the pocket and the closed end of the pocket is not coupled to the fixed surface such that the pocket is hingedly coupled to the fixed surface via the single seam.

In some implementations, the at least one pocket is a first pocket and the fixed surface within the bag cavity is a first fixed surface, and the system further comprises a second pocket that is disposed within the bag cavity and coupled to the first fixed surface or another fixed surface within the bag cavity by a single seam extending substantially parallel to the longitudinal axis of the second pocket and the closed end of the second pocket is not coupled to the fixed surface such that the second pocket is hingedly coupled to the fixed surface via the single seam of the second pocket.

In some implementations, the fixed surface is an inner surface of the bag side wall, a liner coupled to the bag side wall, a side seam of a liner coupled to the bag side wall, a surface of a bag divider wall, or a side seam coupling two bag side walls.

In some implementations, the pocket side wall further comprises a sheet material and a covering material that extends over at least an inner surface of the sheet material. The inner surface of the sheet material faces the pocket cavity, and the sheet material has a stiffness that is greater than a stiffness of the covering material.

In some implementations, the covering material is fabric, leather, or vinyl.

In some implementations, the sheet material is selected from the group consisting of: foam, felt, interfacing textile, cardboard, polymer, metal, and composites thereof.

In some implementations, the covering material is sewn to the fixed surface of the bag, and the sheet material is encapsulated by the covering material but is not sewn to the fixed surface of the bag.

In some implementations, a portion of the covering material extends past the second edge of the sheet material to form the closed end of the pocket.

In some implementations, the at least one pocket side wall is a single side wall, the single side wall encircles the pocket cavity, and the single seam is formed with a portion of the covering material that extends past a perimeter of the sheet material in a direction perpendicular to the longitudinal axis of the pocket cavity.

In some implementations, the single pocket side wall is rectangular shaped and comprises third and fourth edges that extend between the first and second edges of the pocket side wall and are opposite and spaced apart from each other. And, the pocket side wall is folded about an axis that extends through the first and second edges of the pocket side wall such that the third and fourth edges are adjacent each other and are coupled together and to the fixed surface of the bag via the single seam.

In some implementations, the covering material is fabric, and the sheet material is rectangular shaped and comprises a score that extends from a center of a first edge of the sheet material to a center of a second edge of sheet material, wherein a first portion of the sheet material is on one side of the score and a second portion of the sheet material is on the other side of the score, and wherein the first and second portions are spaced further apart from each other to define the pocket cavity in an expanded configuration than in a collapsed configuration.

In some implementations, the score is a first score, and the sheet material comprises additional scores that extend from the first edge of the sheet material to the second edge of the sheet material, the sheet material being bendable about the scores for collapsing and expanding.

In some implementations, the scores comprise second, third, and fourth scores that are spaced apart from each other and a third edge of the sheet material in the first portion, and fifth, sixth, and seventh scores that are spaced apart from each other and a fourth edge of the sheet material in the second portion, wherein the third and fourth edges of the sheet material extend between the first and second edges and are opposite and spaced apart from each other.

In some implementations, the pocket is a first pocket and the bag organizer system comprises a second pocket, the second pocket being coupled to the first pocket, and the second pocket having a length, a width, and a depth that is less than the length, width, and depth of the first pocket, and wherein the opening of the second pocket is adjacent the opening of the first pocket.

In some implementations, the single seam of the second pocket is coupled to the single seam of the first pocket and the fixed surface of the bag.

In some implementations, an outer surface of the bag side wall defines a pocket, the bag side wall pocket configured for receiving a smartphone or mobile computing device.

In some implementations, the at least one bag side wall comprises a piece of material having a rectangular shape with first, second, third, and fourth edges. The first edge of the bag side wall material corresponds with the first edge of the bag. The second edge of the bag side wall material is opposite and spaced apart from the first edge of the bag material, and the third and fourth edges of the bag side wall material extend between the first and second edges and are opposite and spaced apart from each other. The bag side wall material is folded about an axis that extends between the first and second edges such that the first and second edges define the opening to the bag cavity. And, the third and fourth edges are coupled together to form side seams.

In some implementations, the at least one pocket side wall comprises a sheet material that extends from the first edge of the pocket side wall to the second edge of the pocket side wall, wherein the sheet material is sufficiently stiff such that the first edge of the pocket side wall does not collapse toward or away from the pocket cavity under the force of gravity.

In some implementations, the sheet material is selected from the group consisting of: foam, felt, interfacing textile, cardboard, polymer, metal, and composites thereof.

In some implementations, the at least one pocket side wall is a single side wall that encircles the pocket cavity.

According to other various implementations, a bag organizer system includes a bag and at least one pocket. The bag has at least one bag side wall, wherein the at least one bag side wall at least partially defines a bag cavity, and a first edge of the at least one bag side wall at least partially defines an opening to the bag cavity. The at least one pocket disposed within the bag cavity and fixedly coupled to a fixed surface within the bag cavity, the pocket comprising at least one pocket side wall having a first edge and a second edge that is opposite the first edge along a longitudinal axis of the pocket, wherein the at least one pocket side wall at least partially defines a pocket cavity, the first edge of the pocket side wall at least partially defines an opening to the pocket cavity, and the second edge of the pocket side wall at least partially defines a closed end of the pocket cavity. The first edge of the pocket side wall is closer to the opening of the bag than the second edge of the pocket side wall. The pocket is expandable and collapsible. The at least one pocket side wall comprises a sheet material that extends from the first edge of the pocket side wall to the second edge of the pocket side wall, wherein the sheet material is sufficiently stiff such that the first edge of the pocket side wall does not collapse toward or away from the pocket cavity under the force of gravity. A length of the pocket as measured in the direction of the pocket longitudinal axis is greater than a greatest width and/or depth of the pocket when expanded, wherein the width and depth are measured in directions perpendicular to the longitudinal axis and in the same plane, and wherein the width and depth of the pocket are less than a width and a depth of the bag, respectively. And, the pocket is coupled to the fixed surface by at least one seam extending substantially parallel to the longitudinal axis of the pocket.

In some implementations, the at least one seam comprises first and second side seams that are spaced apart from each other such that the opening of the pocket is between them.

In some implementations, the at least one pocket side wall comprises a first pocket side wall and a second pocket side wall, the sheet material of the first and second pocket side walls substantially encircling the pocket cavity, wherein each pocket side wall comprises a third edge and a fourth edge that each extend between the first and second edges of the respective pocket walls, and the third edges of each pocket side wall are coupled together and the fourth edges of each pocket side wall are coupled together.

In some implementations, a covering material encapsulates the sheet material of each of the first and second pocket side walls, the sheet material of each pocket side wall is rectangular shaped and has third and fourth edges that are adjacent to but are spaced inwardly from the third and fourth edges of the respective pocket side wall, and the covering material extends past the third and fourth edges of the sheet material to the third and fourth edges of the respective pocket side wall.

In some implementations, the at least one pocket is a first pocket and the fixed surface within the bag cavity is a first fixed surface, and the system further comprises a second pocket that is disposed within the bag cavity and coupled to the first fixed surface or another fixed surface within the bag cavity by at least one seam on the second pocket extending substantially parallel to the longitudinal axis of the pocket.

In some implementations, the fixed surface is an inner surface of the bag side wall, a liner coupled to the bag side wall, a side seam of a liner coupled to the bag side wall, a surface of a bag divider wall, or a side seam coupling two bag side walls.

In some implementations, the at least one pocket side wall is a single side wall, the single side wall encircles the pocket cavity, the single side wall comprises a sheet material and a covering material that encapsulates the sheet material, wherein the at least one seam is formed with a portion of the covering material that extends past a perimeter of the sheet material in a direction perpendicular to the longitudinal axis of the pocket cavity, the sheet material having a stiffness greater than the covering material.

In some implementations, the single pocket side wall is rectangular shaped and comprises third and fourth edges that extend between the first and second edges of the pocket side wall and are opposite and spaced apart from each other. And, the pocket side wall is folded about an axis that extends through the first and second edges of the pocket side wall such that the third and fourth edges are adjacent each other and are coupled together and to the fixed surface of the bag via the at least one seam.

In some implementations, the pocket side wall further comprises a covering material that extends over at least an inner surface of the sheet material, the inner surface of the sheet material facing the pocket cavity, the sheet material having a stiffness that is greater than a stiffness of the covering material.

In some implementations, the covering material is selected from the group consisting of: fabric, leather, and vinyl.

In some implementations, the covering material is sewn to the fixed surface of the bag, and the sheet material is encapsulated by the covering material but is not sewn to the fixed surface of the bag.

In some implementations, the covering material extends past the second edge of the sheet material to form the closed end of the pocket.

In some implementations, the closed end of the pocket is not coupled to the fixed surface.

In some implementations, the covering material is fabric, and the sheet material is rectangular shaped and comprises a score that extends from a center of a first edge of the sheet material to a center of a second edge of sheet material, wherein a first portion of the sheet material is on one side of the score and a second portion of the sheet material is on the other side of the score, and wherein the first and second portions are spaced further apart from each other to define the pocket cavity in an expanded configuration than in a collapsed configuration.

In some implementations, the score is a first score, and the sheet material comprises additional scores that extend from the first edge of the sheet material to the second edge of the sheet material, the sheet material being bendable about the scores for collapsing and expanding.

In some implementations, the scores comprise second, third, and fourth scores that are spaced apart from each other and a third edge of the sheet material in the first portion, and fifth, sixth, and seventh scores that are spaced apart from each other and a fourth edge of the sheet material in the second portion, wherein the third and fourth edges of the sheet material extend between the first and second edges and are opposite and spaced apart from each other.

In some implementations, the pocket is a first pocket and the bag organizer system comprises a second pocket, the second pocket being coupled to the first pocket, and the second pocket having a length, a width, and a depth that is less than the length, width, and depth of the first pocket, and wherein the opening of the second pocket is adjacent the opening of the first pocket.

In some implementations, at least one seam of the second pocket is coupled to one of the at least one seam of the first pocket and the fixed surface of the bag.

In some implementations, an outer surface of the bag side wall defines a pocket, the bag side wall pocket configured for receiving a smartphone or mobile computing device.

In some implementations, the at least one bag side wall comprises a piece of material having a rectangular shape with first, second, third, and fourth edges. The first edge of the bag side wall material corresponds with the first edge of the bag. The second edge of the bag side wall material is opposite and spaced apart from the first edge of the bag material, and the third and fourth edges of the bag side wall material extend between the first and second edges and are opposite and spaced apart from each other. The bag side wall material is folded about an axis that extends between the first and second edges such that the first and second edges define the opening to the bag cavity. And, the third and fourth edges are coupled together to form side seams.

In some implementations, the sheet material is selected from the group consisting of: foam, felt, interfacing textile, cardboard, polymer, metal, and composites thereof.

According to various implementations, a bag organizer system includes at least one pocket configured for being fixedly coupled to a fixed surface within a bag cavity of a bag. The pocket includes at least one pocket side wall having a first edge and a second edge that is opposite the first edge along a longitudinal axis of the pocket, wherein the at least one pocket side wall at least partially defines a pocket cavity, the first edge of the pocket side wall at least partially defines an opening to the pocket cavity, and the second edge of the pocket side wall at least partially defines a closed end of the pocket cavity. The at least one pocket side wall comprises a sheet material that extends between the first edge and the second edge of the pocket side wall and encircles the pocket cavity. The sheet material is sufficiently stiff such that the first edge of the pocket side wall does not collapse toward or away from the pocket cavity under the force of gravity. The pocket is expandable and collapsible, and a length of the pocket as measured in the direction of the pocket longitudinal axis is greater than a greatest width and/or depth of the pocket when expanded, wherein the width and depth are measured in directions perpendicular to the longitudinal axis and in the same plane.

According to various implementation, a bag organizer system includes at least one pocket. The pocket comprising at least one pocket side wall having a first edge and a second edge that is opposite the first edge along a longitudinal axis of the pocket. The at least one pocket side wall at least partially defines a pocket cavity, the first edge of the pocket side wall at least partially defines an opening to the pocket cavity, and the second edge of the pocket side wall at least partially defines a closed end of the pocket cavity. The at least one pocket side wall comprises a sheet material that extends between the first edge and the second edge of the pocket side wall and encircles the pocket cavity. The sheet material is sufficiently stiff such that the pocket side wall does not collapse toward or away from the pocket cavity under the force of gravity. The pocket is expandable and collapsible, and a length of the pocket as measured in the direction of the pocket longitudinal axis is greater than a greatest width and/or depth of the pocket when expanded, wherein the width and depth are measured in directions perpendicular to the longitudinal axis and in the same plane. A coupling device is coupled to the pocket and has a portion that extends outside of a perimeter of the pocket. The portion extending outside of the perimeter of the pocket is configured for coupling the pocket to a fixed surface within a bag cavity of the bag. In some implementations, the coupling device is a hook or a loop.

BRIEF DESCRIPTION OF THE DRAWINGS

Example features and implementation are disclosed in the accompanying drawings. However, the present disclosure is not limited to the arrangements and instrumentalities shown. Furthermore, various features may not be drawn to scale.

DETAILED DESCRIPTION

Figure 1A:
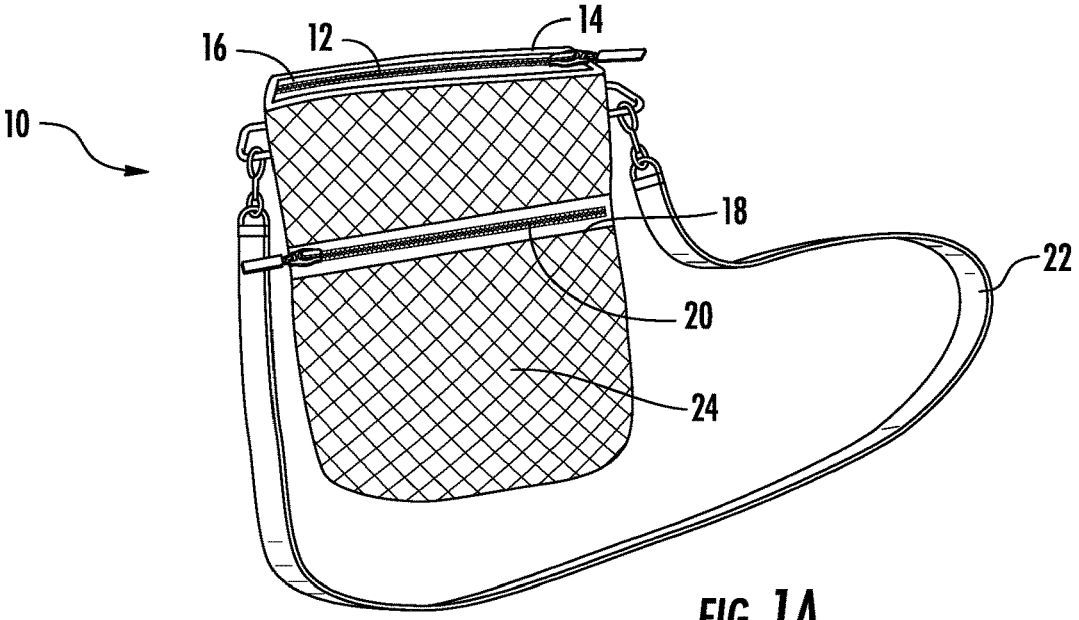
FIG. 1A shows a perspective side view of a cross body style handbag/purse according to one implementation.

Various implementations include a built-in bag organizer system for a bag. Example bags include a handbag (or "purse"), travel bag, backpack, tote bag, beach bag, carry-on bag, suitcase, overnight bag, "man-purse" (also known as a "murse"), etc. The bag organizer system may include pockets for items such as eyewear, lip wear, mobile phone, identification (ID) card or passport, credit card(s), and/or keys. In some implementations, ID cards/passports, money, and credit cards may be stored in a separate wallet that can be disposed within the bag.

In some implementations, the bag organizer system is designed to smartly organize and carry these everyday items. According to some implementations, the bag organizer system:

1. Protects mobile phones from scratches from other objects in bag;
2. Keeps clean and prevents scratches and crushing or other damage to eyewear from other objects in bag;
3. Creates easy access to all essential items without the user having to feel around or take items out of the bag to get what is needed;
4. Allows one handed access to eyeglasses and mobile phones and for the ability to retrieve these items from the bag using just one hand, if desired;
5. Allows unused pockets to be collapsed to make room for other objects; and/or
6. Creates a smart, sleek, and sophisticated style handbag appealing to all generations.

People with smaller handbags tend to struggle to access what is needed when reaching into their handbag. For example, they have to pull things out to get to keys at the bottom or find lipstick somewhere in the middle. And, bags do not provide a protective pocket for eyewear, which allows the eyewear to be scratched or crushed/damaged when stored in the bag.

Seldom do people need to bring a bulky wallet filled with credit cards, checkbook, change, photos, etc. These items are not necessary most of the time and just take up valuable space. The wallet shown in FIG. 4 and discussed below has room for essential wallet items with easy access and less bulk.

Various implementations of the bag organizer system provide organization and streamline ease of use for the way we live and work. According to some implementations, the bag organizer system comes in various styles, colors, patterns, and materials, with a keen sense of design and detail for the interior and exterior for the bag.

According to various implementations, the bag organizer system includes at least one eyewear pocket that is configured for being coupled to a fixed surface within a cavity of a bag. The eyewear pocket is configured for storing and protecting eyewear, such as sunglasses or eyeglasses. The eyewear pocket includes at least one eyewear pocket side wall that has a first edge and a second edge that is opposite the first edge along a longitudinal axis of the eyewear pocket. The at least one eyewear pocket side wall at least partially defines an eyewear pocket cavity, and the first edge of the eyewear pocket side wall at least partially defines an opening to the eyewear pocket cavity. The second edge of the eyewear pocket side wall at least partially defines a closed end of the eyewear pocket cavity. The first edge defining the eyewear pocket opening is closer to the bag opening than the second edge. The eyewear pocket is expandable and collapsible. When expanded, objects can be stored and accessed within the pocket cavity. In addition, a length of the eyewear pocket as measured in the direction of the eyewear pocket longitudinal axis is greater than a greatest width and/or depth of the eyewear pocket when expanded, wherein the width and depth are measured in directions perpendicular to the longitudinal axis and in the same plane.

In some implementations, the pocket is fixedly coupled to the fixed surface within the bag cavity by a single seam, and the closed end of the pocket is not coupled to the fixed surface such that the pocket is hingedly coupled to the fixed surface via the single seam. The single seam, according to some implementations, extends substantially parallel to the longitudinal axis of the pocket. For example, in some implementations, the single seam may extend at an angle including and between 0° and 30° relative to the longitudinal axis of the pocket. In other implementations, the single seam may extend at an angle between 30° and 60°.

In some implementations, the at least one eyewear pocket side wall includes a sheet material that extends between the first edge and the second edge of the eyewear pocket side wall. The sheet material is sufficiently stiff such that the first edge of the pocket side wall does not collapse toward or away from the pocket cavity under the force of gravity.

The bag organizer system may also include a bag to which the pocket is coupled. The bag includes at least one bag side wall that at least partially defines a bag cavity and a first edge of the at least one bag side wall that at least partially defines an opening to the bag cavity. In addition, the width and depth of the eyewear pocket are less than a width and a depth of the bag, respectively.

In various implementations, the first edge of the bag and/or the external pocket may include another suitable type of closure or no closure. For example, suitable types of closures may include a zipper, at least one magnet, a flap, or a clasp.

In various implementations, the side wall(s) of the bag may be made of any type of materials suitable for a bag, such as, but not limited to, fabric, quilted fabric, leather, foam, vinyl, or canvas.

FIGS. 1A through 13 illustrates various implementations of the bag organizer system and methods of assembly.

Figure 1B:
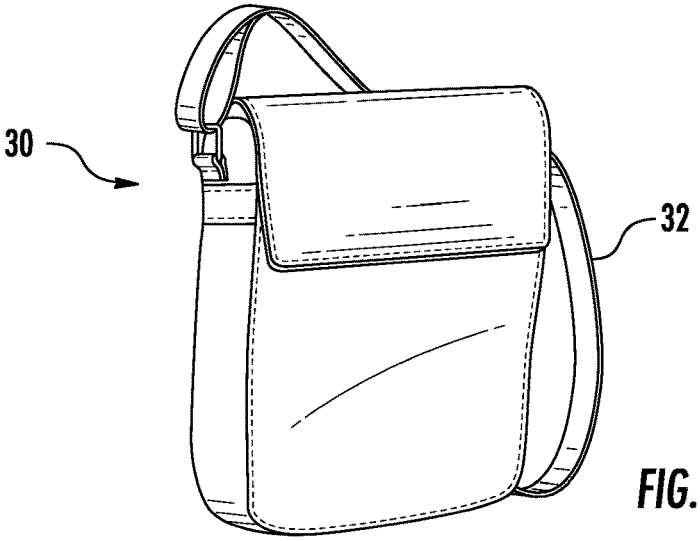
FIG. 1B also shows a perspective side view of a bag that includes a top opening with a flap secured with a closure according to another implementation.

For example, FIG. 1A illustrates a handbag 10 that includes a bag organizer system according to one implementation. The handbag 10 is a cross body style bag with a main zipper closure 12 along a first edge 14 of the handbag 10. The first edge 14 defines an opening to a bag cavity 16. The handbag 10 is about 7" wide and about 9" long, but the dimensions can vary in other implementations. The handbag 10 has an external pocket 18 with a zipper closure 20 on one side of the bag, as shown in FIG. 1A, and an external pocket without a closure on the other side of the bag (not shown). The one or more external pockets 18 may be used for storing a smartphone or mobile electronics device, for example, or other items that the user wishes to store and retrieve easily separately from the objects stored within the bag cavity 16. In addition, external surfaces 24 of the side wall(s) of the handbag 10 are made of a quilted material. And, the handbag 10 includes a cross body strap 22 that can be adjusted to an over-the-shoulder option. In other implementations, the external surfaces of the side wall(s) of the handbag may be formed of fabric, quilted fabric, leather, vinyl, canvas, foam or other suitable material. In addition, the bag is not limited to a particular shape, size, or style. For example, the bags in FIGS. 1A and 1B are handbags that have cross body adjustable straps 22, 32, but in other implementations, the bag may include a travel bag, backpack, tote bag, beach bag, carry-on bag, suitcase, or overnight bag. In other implementations, the straps may not be adjustable.

Figure 2:
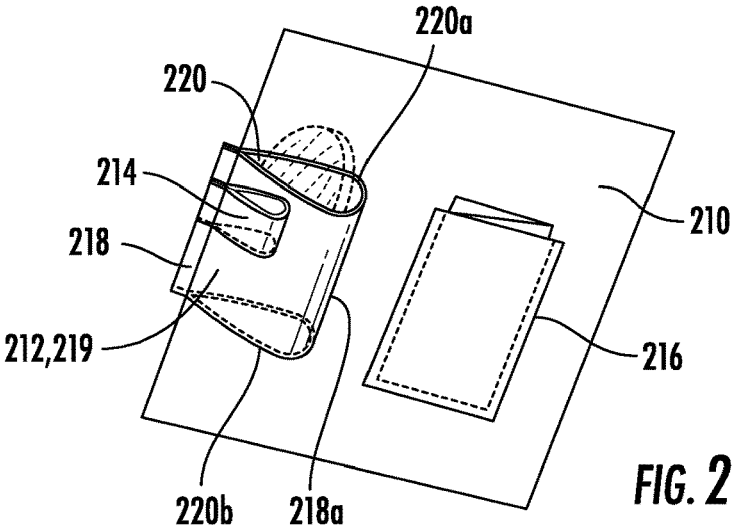
FIG. 2 shows a front view of an interior wall of the main cavity of the handbag shown in FIG. 1A.

FIG. 2 shows an interior wall 210 of the handbag 10 shown in FIG. 1A. Attached to the interior wall 210 is an eyewear pocket 212, a lip wear pocket 214, and a wallet pocket 216. The interior wall 210 may be a fixed inner surface (or liner) of a side wall of the handbag 10 that faces and defines, at least in part, the bag cavity 16 of the handbag 10, the inner surface of the side wall of the handbag 10, or a fixed divider that extends through the cavity 16 of the handbag 10.

The eyewear pocket 212 includes a sheet material and a covering material 218 that form an eyewear pocket side wall 219. The sheet material of the eyewear pocket side wall 219 encircles an eyewear pocket cavity 220, and the covering material 218 encapsulates the sheet material. In some implementations, the sheet material may include foam, felt, interfacing textile, cardboard, polymer, metal (e.g., metal spring plate), and/or composites thereof. The thickness of the sheet material may be 0.1 to 0.4 inches, in some implementations. In addition, the sheet material may be movable between the expanded and collapsed positions with a force that can be applied by the object moving into the cavity or by the user's hand, which allows the user to access the pocket one-handedly, according to some implementations. Furthermore, in this implementation, the opening to the eyewear pocket cavity 220 is unobstructed from the opening of the bag 10 to facilitate one-handed access to the pocket 212. In other words, there is no flap or covering over the opening to the eyewear pocket cavity 220.

The covering material 218 is fabric in the implementation shown, but in other implementations, the covering material 218 may include leather, vinyl, foam, or other suitable soft covering material.

The sheet material extends the full length of the eyewear pocket 212 and substantially around a perimeter of the pocket 212 to provide impact protection to eyewear stored therein from any side of the pocket 212. The covering material 218 extends from each side edge of the sheet material. Side edges of the sheet material and the covering material 218 are coupled together to create the pocket cavity 220 and an opening 220*a* to the cavity 220, and the side edges of at least the covering material that are substantially parallel with a longitudinal axis of the pocket cavity are sewn or otherwise coupled together and to the interior wall 210 of the handbag 10. Edges of the covering material that extend in a direction that is substantially transverse to the longitudinal axis are sewn or otherwise coupled together to form a closed end 220*b* of the pocket 212. In this implementation, the sheet material is one monolithic piece of material, but in other implementations, the sheet material comprises a plurality of pieces of material that are coupled to each other directly or indirectly to provide vertical stiffness to the pocket side wall.

When the eyewear pocket 212 is coupled to the interior wall 210, a center portion 218*a* of the covering material 218 and the sheet material are distally disposed relative to the interior wall 210, and the side edges of the covering material 218 and sheet material are proximally disposed relative to the interior wall 210. The pocket 212 is collapsible in a radial direction relative to the central longitudinal axis of the pocket to provide space flexibility when eyeglasses are not stored in the pocket 212, and the pocket side wall 219 expands radially outwardly relative to the central longitudinal axis of the pocket to receive and store the eyewear. Because the pocket 212 is attached to the interior wall 210 along a single side seam and the bottom wall of the pocket is not attached to the interior wall, the pocket can hinge, or pivot, about the seam, which provides additional space flexibility within the cavity of the handbag 10. The sheet material of the pocket 212 maintains the length of the pocket 212 and keeps the pocket 212 upright, which prevents eyewear stored therein from falling out of the pocket 212 and prevents the side wall 219 of the pocket 212 from sagging or moving relative to the eyewear stored in the pocket 212. The lip wear pocket 214 is made similarly to the eyewear pocket 212 and is coupled to the eyewear pocket 212, but has smaller dimensions (length, width, and/or depth) than the eyewear pocket 212. In particular, the seam of the eyewear pocket 212 and the seam of the lip wear pocket 214 are aligned and coupled together and to the interior wall 210. The first edges of the eyewear pocket and lip wear pocket side walls are closer to the opening of the bag than the second edges of the pockets. In addition, in some implementations, the first edges of the pockets are disposed adjacent the opening of the bag (e.g., just below the closure along the first edge of the bag such that the bag is closable when the pockets include the eyeglasses and lip wear). In other implementations, the lip wear pocket can be attached to other portions of the eyewear pocket or to other portions of the interior surfaces of the bag.

Figure 4:
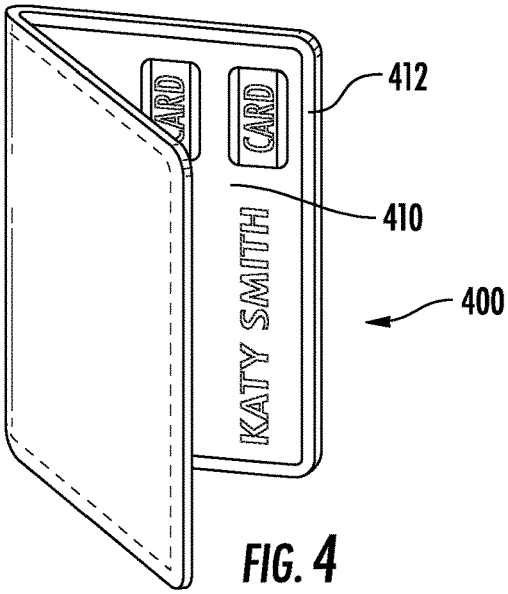
FIG. 4 shows a perspective view of a wallet according to one implementation.

The interior wall 210 of the handbag 10 shown in FIG. 2 also includes a wallet pocket 216 for storing a wallet, such as wallet 400 shown in FIG. 4, or ID/credit cards(s) within the handbag 10. The wallet pocket 216 may be formed of fabric, quilted fabric, leather, vinyl, canvas, foam or other suitable material. The wallet pocket 216 shown in FIG. 2 is sewn to the interior wall 210 of the handbag 10 along the side edges and bottom edge of the wallet pocket 216. In other implementations, the wallet pocket 216 may be coupled to the interior wall 210 by another suitable fastening mechanism, such as, for example, magnets, clasps, rivets, hook/loop material, or adhesive.

Figure 3:
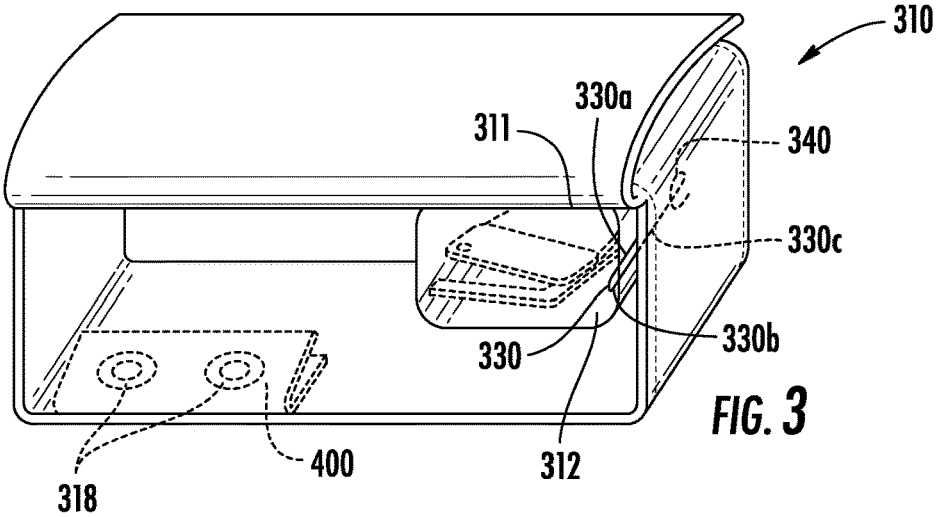
FIG. 3 shows a top perspective view of a pocket in a handbag according to another implementations.

FIG. 3 illustrates a handbag 310 having a bag organizing system according to another implementation. The bag organizing system includes an eyewear pocket 312 that is removably coupled to the interior surface 311 of the handbag 30 shown in FIG. 1B via a coupling device 330. The coupling device 330 in this implementation is a hook that has a fixed end 330*a* fixedly coupled to the pocket 312 and a portion 330*b* that extends outside of a perimeter of the pocket 312. The portion 330*b* extends between the fixed end 330*a* and a free end 330*c*. The free end 330*c* hooks into a loop 340 fixedly coupled to the interior surface 311 of the bag 30 to couple the pocket 312 within the bag cavity. For example, the hook may include metal and/or plastic wire. One or more lip wear pockets may be coupled to an exterior surface of the eyewear pocket 312, but they are not shown in FIG. 3. The eyewear pocket 312 may be made similarly to the pocket 212 described above in FIG. 2, may include a sheet material such as described above without a covering material, or may include a sheet material such as described above with a covering material on the side of the pocket side wall that faces the pocket cavity. And, in other implementations, the hook may extend over the side of the bag wall, or the coupling device may be a loop coupled to the pocket side wall that engages a hook that is coupled to the bag interior wall. In other implementations, the coupling device is a strip of one of hook or loop material that is coupled to the pocket and engages with a strip of the other loop or hook material that is coupled to the interior surface of the bag. And, in other implementations, the coupling device is one of a magnetic material and a magnet that can be coupled to the other of the magnet or the magnetic material that is coupled to the interior surface of the bag.

The bag 30 also includes a magnetic holder 318 for coupling to a custom ID/credit card(s) wallet, such as the wallet 400 shown in FIG. 4. FIG. 4 illustrates a wallet 400 for storing ID/Credit card(s), according to one implementation. In the implementation shown in FIG. 2, the wallet 400 is stored within the pocket 216. In the implementation shown in FIG. 3, the wallet 400 includes a magnetic material, such as one or more magnetic buttons or strips or a magnetic fabric, and the wallet 400 is removably coupled to the interior surface 311 of the handbag 30 by one or more magnets 318. In other implementations, the wallet may be coupled to the internal surface of the bag by other suitable fasteners, such as clasps, rivets, hook/loop material, or adhesive. In some implementations, the wallet is not removable from the internal surface of the bag, and the wallet defines an opening through which the card(s) stored therein may be accessed.

FIG. 4 is a close up of the custom ID/Credit card(s) wallet 400. The wallet 400 is designed to have a designated secure place within each bag. One side of the of wallet may have a transparent material 410 over a face of the pocket 412 to provide visibility of the photo/ID and/or cards stored therein. The other side may be transparent, translucent, or opaque. In some implementations, the wallet 400 comprises an RFID shielding material to prevent theft of personal information stored on the cards in the wallet 400.

FIGS. 5-10 and 13 illustrate a bag organizer system and components thereof according to another implementation. In this implementation, the eyewear pocket 612 is coupled to a liner 614 that is fixedly coupled to the handbag 500. The eyewear pocket 612 is fixedly coupled to the liner 614 by a single seam 616 extending substantially parallel to the longitudinal axis of the pocket 612, such as is described above in relation to FIG. 2. The eyewear pocket side wall 618 is a single side wall. In other implementations, the bag 500 may not include a fixed liner, and the eyewear pocket 612 may be fixedly coupled to an interior surface of the bag 500.

Figure 8:
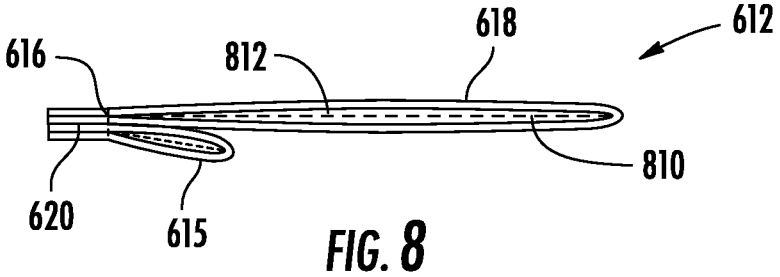
FIG. 8 illustrates a top view of the pocket shown in FIG. 6 in the collapsed configuration and not attached to the fixed surface of the bag.
Figure 9:
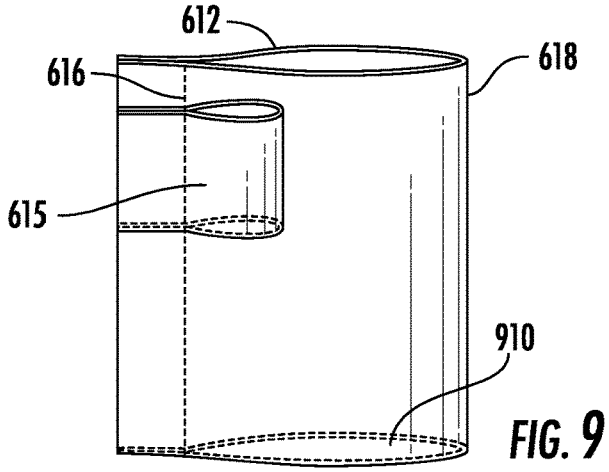
FIG. 9 illustrates a perspective view of the pocket shown in FIG. 6 between the collapsed configuration and the expanded configuration and not attached to the fixed surface of the bag.
Figure 10:
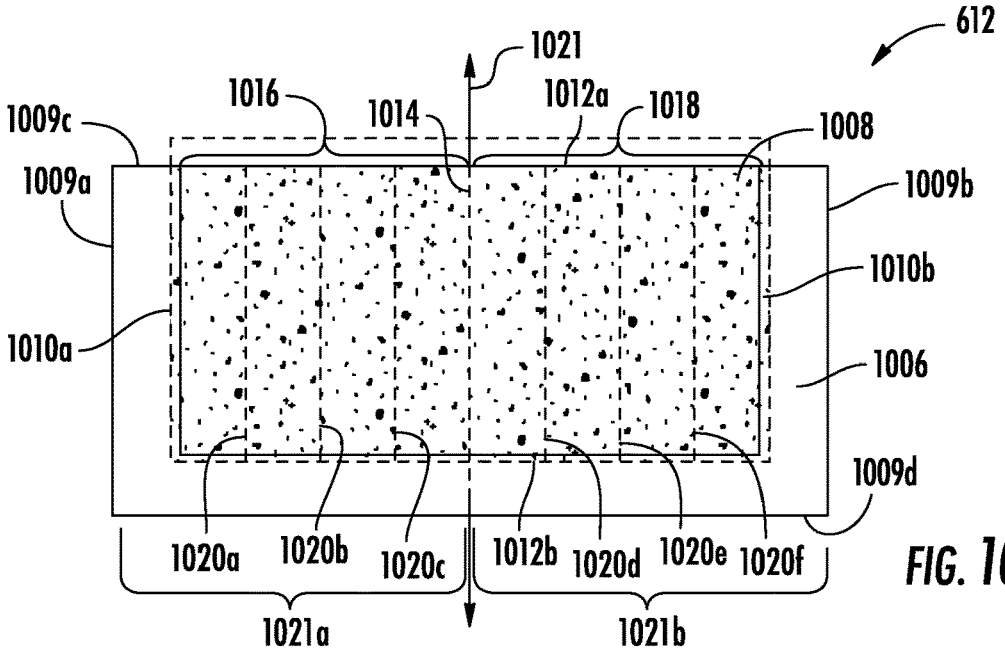
FIG. 10 illustrates a side view of the pocket shown in FIG. 6 during the process of assembling the pocket.

As shown in FIGS. 6-10, the single seam 616 is formed with a portion 620 of the covering material 1006 that extends past side edges 1010*a*, 1010*b* of the sheet material 1008 in a direction that is transverse (e.g., perpendicular) to the longitudinal axis 710 of eyewear pocket cavity 812 formed by the side wall 618. Prior to assembly, as shown in FIG. 10, the single pocket side wall 618 is rectangular shaped and comprises third edge 1009*a* and fourth edge 1009*b* that extend between first edge 1009*c* and second edge 1009*d* of the pocket side wall 618 and are opposite and spaced apart from each other. The pocket side wall 618 is folded about center line 1021, which extends through the first and second edges 1009*c*, 1009*d* of the pocket side wall 618, such that the third and fourth edges 1009*a*, 1009*b* are adjacent each other and are coupled together and to the liner 614 of the bag 500 via the single seam 616 (see FIGS. 6-9). The sheet material 1008 is not sewn or otherwise directly coupled to the liner 614 of the bag 500.

Figure 6:
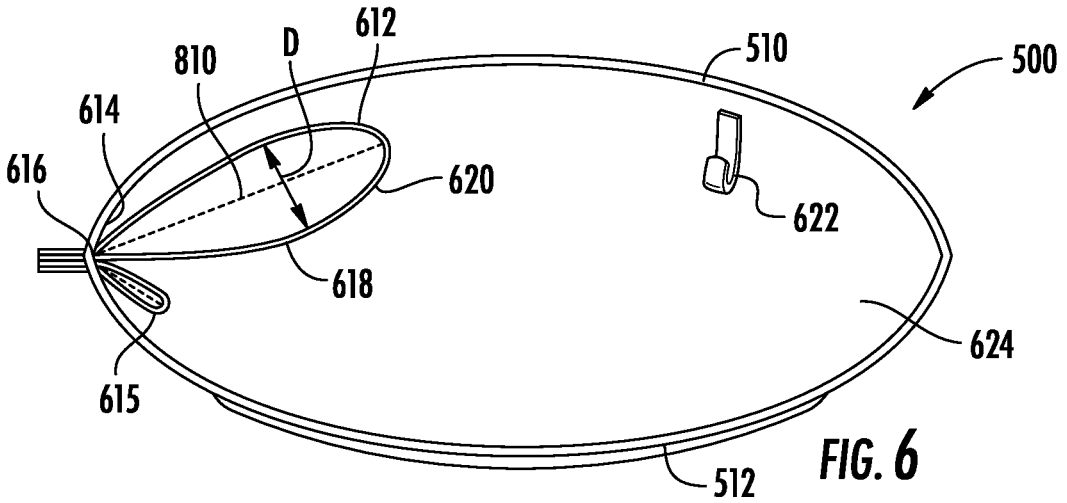
FIG. 6 illustrates a top view of the bag shown in FIG. 5. The pocket in the bag is shown in the expanded configuration.
Figure 7:
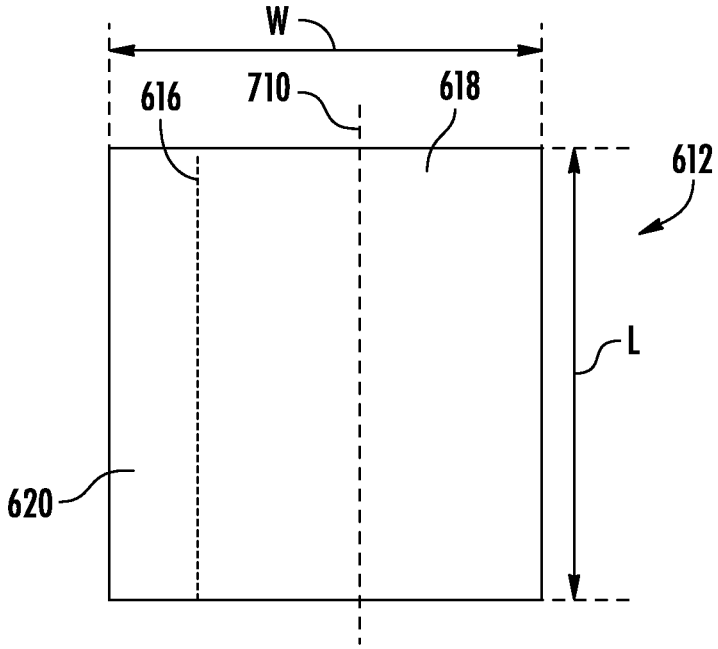
FIG. 7 illustrates a side view of the pocket shown in FIG. 6.

Also, as shown in FIG. 10, the covering material 1006 extends past a second edge 1012*b* of the sheet material 1008. When the pocket side wall 618 is folded about a center line 1021 that extends through the first and second edges 1009*c*, 1009*d* of the pocket side wall 618, the portion 1021*a* of the covering material 1006 on one side of the center line 1021 of the covering material 1006 and resilient material 1008 is coupled to the portion 1021*b* of the covering material 1008 on the other side of the center line 1021 along seam 810 to form the closed end 910 of the pocket 612. The closed end 910 is not coupled to the liner 614. By having the closed end 910 of the pocket 612 be uncoupled from the liner 614, the pocket 612 can be collapsed and moved about the single seam 616 to provide space flexibility in a cavity 624 of the bag 500. FIG. 6 shows an example of the pocket 612 in the expanded configuration, and FIG. 8 shows an example of the pocket 612 in the collapsed configuration.

Figure 13:
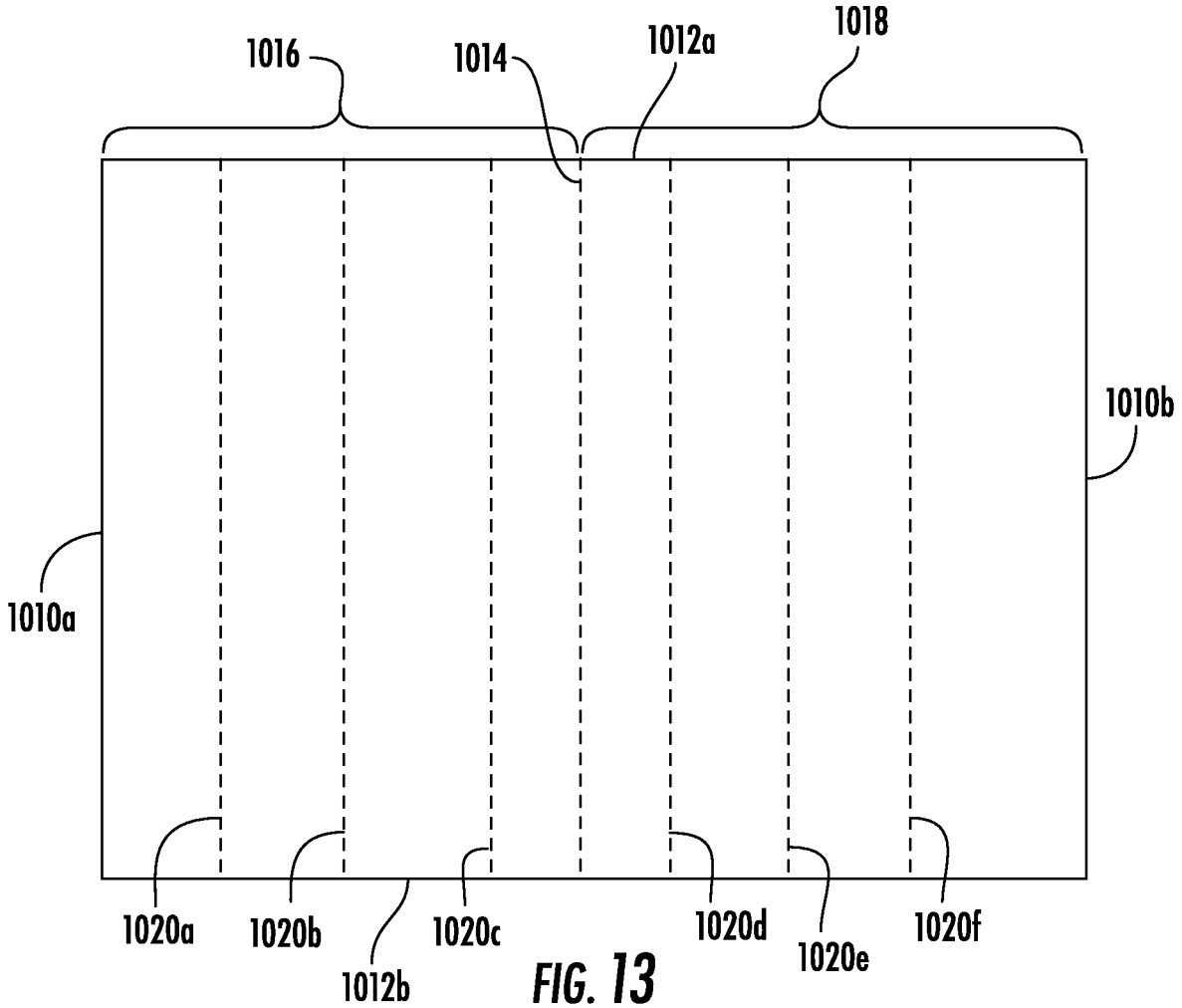
FIG. 13 illustrates a side view of a sheet material having score lines according to one implementation.

Furthermore, as shown in FIGS. 10 and 13, the sheet material 1008 is rectangular shaped. The sheet material 1008 shown in FIGS. 10 and 13 is a polymer sheet material (e.g., polyethylene, polypropylene, poly vinyl chloride, and/or other suitable polymer sheet material).

The sheet material 1008 includes a first score 1014 that extends from a center of a first edge 1012*a* of the sheet material 1008 to a center of the second edge 1012*b* of the sheet material 1008. A first portion 1016 of the sheet material 1008 is on one side of the score 1014 and a second portion 1018 of the sheet material 1008 is on the other side of the score 1014. The sheet material 1008 also includes additional scores 1020*a*, 1020*b*, 1020*c*, 1020*d*, 1020*e*, 1020*f* that extend from the first edge 1012*a* of the sheet material 1008 to the second edge 1012*b* of the sheet material 1008, and the scores 1020*a*, 1020*b*, 1020*c*, 1020*d*, 1020*e*, 1020*f* allow the sheet material 1008 to bend and straighten at the scores 1020*a*, 1020*b*, 1020*c*, 1020*d*, 1020*e*, 1020*f* for expanding and collapsing the pocket 612. The first and second portions 1016, 1018 are spaced apart further from each other to define the pocket cavity 812 in the expanded configuration than in the collapsed configuration. FIG. 8 illustrates the collapsed configuration, FIG. 6 illustrates the expanded configuration, and FIG. 9 illustrates the pocket between the collapsed configuration and the expanded configuration. In the implementation shown in FIG. 10, the sheet material 1008 has second 1020*a*, third 1020*b*, and fourth 1020*c* scores that are spaced apart from each other and side edge 1010*a* of the sheet material 1008 in the first portion 1016, and the sheet material 1008 has fifth 1020*d*, sixth 1020*e*, and seventh scores 1020*f* that are spaced apart from each other and side edge 1010*b* of the sheet material 1008 in the second portion 1018. The side edge 1010*a* and side edge 1010*b* of the sheet material 1008 extend between the first 1012*a* and second edges 1012*b* and are opposite and spaced apart from each other. FIG. 13 shows the sheet material of FIG. 10 with the score lines and without the covering material.

Figure 11:
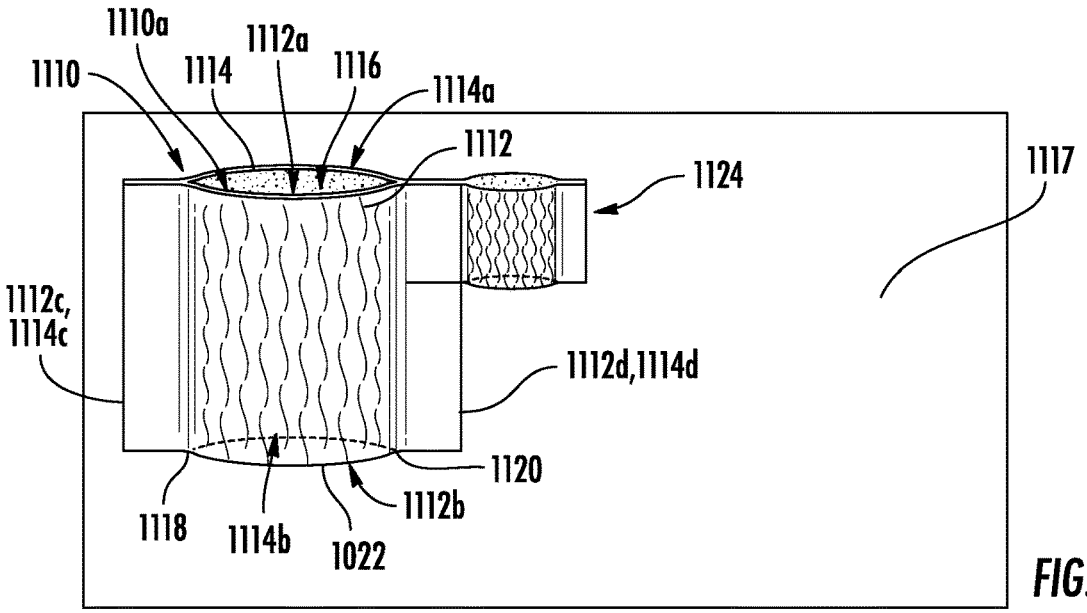
FIG. 11 illustrates a perspective side view of an eyewear pocket and a lip wear pocket according to another implementation coupled to a fixed surface within a bag.

FIG. 11 shows an eyewear pocket 1110 according to another implementation. In this implementation, the eyewear pocket 1110 has first and second eyewear pocket side walls 1112, 1114. The side walls 1112, 1114 are made similarly to the side wall 618 described above in relation to FIGS. 5-10 and 13 in that they each include a sheet material, such as material 1008 and a covering material, such as material 1006. The sheet materials of the first and second eyewear pocket side walls 1112, 1114 together substantially encircle an eyewear pocket cavity 1116 defined by the side walls 1112, 1114. Each eyewear pocket side wall 1112, 1114 comprises a third edge 1112*c*, 1114*c* and a fourth edge 1112*d*, 1114*d* that each extend between first 1112*a*, 1114*a* and second edges 1112*b*, 1114*b* of the respective eyewear pocket walls 1112, 1114. The third edges 1112*c*, 1114*c* of each eyewear pocket side wall 1112, 1114 are coupled together, and the fourth edges 1112*d*, 1114*d* of each eyewear pocket side wall 1112, 1114 are coupled together. A covering material encapsulates the sheet material of each of the first and second eyewear pocket side walls 1112, 1114. The sheet material of each eyewear pocket side wall 1112, 1114 is rectangular shaped and has third and fourth edges that are adjacent to but are spaced inwardly from the third 1112*c*, 1114*c* and fourth edges 1112*d*, 1114*d* of the respective eyewear pocket side wall 1112, 1114. The covering material extends past the third and fourth edges of the sheet material to the third 1112*c*, 1114*c* and fourth edges 1112*d*, 1114*d* of the respective eyewear pocket side wall 1112, 1114. The portions of the covering material that extend past the third and fourth edges are coupled together, and these portions are coupled to the fixed surface 1117 of the bag cavity by first 1118 and second side seams 1120 that are spaced apart from each other such that the opening 1110*a* of the eyewear pocket 1110 is between them. In this implementation, the portions are coupled to each other and the fixed surface by sewing. The closed end 1022 of the eyewear pocket 1110 is formed similarly to the closed end 910 of the eyewear pocket 612 described in FIG. 10.

In addition, FIG. 11 shows a lip wear pocket 1124 that is like the eyewear pocket 1110 described above but has smaller dimensions. The lip wear pocket 1124 is coupled to the fixed surface 1117 of the bag adjacent to the eyewear pocket 1110 in this implementation, but it could be attached elsewhere in the bag or to the eyewear pocket in other implementations.

Figure 12:
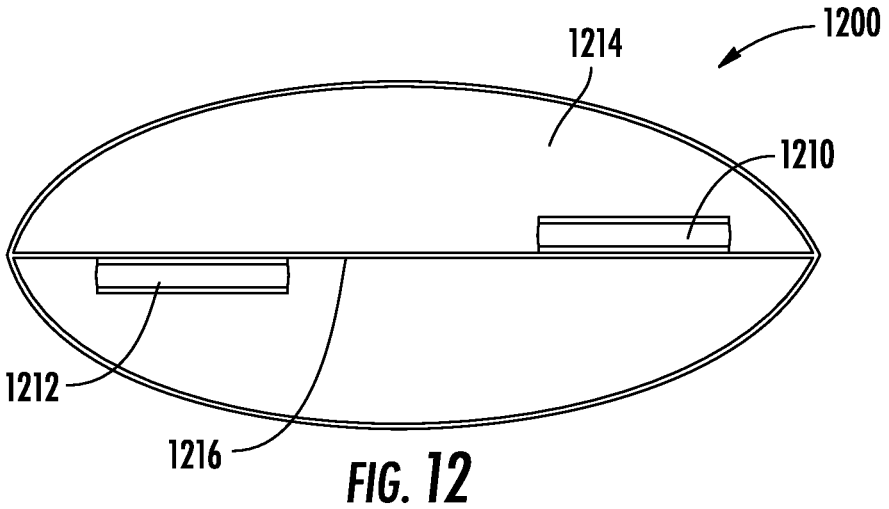
FIG. 12 illustrates first and second eyewear pockets coupled to a divider in a bag, according to another implementation.

In some implementations, the bag organizer system includes two or more eyewear pockets 1210, 1212, such as those described above, that are disposed within the bag cavity 1214 and coupled to the same fixed surface 1216 or to different fixed surfaces within the bag cavity 1214 of a bag 1200. For example, as shown in FIG. 12, first and second eyewear pockets 1210, 1212 are coupled to a divider 1216 of the bag.

In the implementation shown in FIG. 6, the fixed surface is a side seam of a liner 614 that is coupled to the first edge of the bag side wall 510. However, in other implementations, the fixed surface may be an inner surface of the bag side wall, another portion of the liner coupled to at least a portion of the bag side wall, a surface of a bag divider wall, or a side seam coupling two portions of a material that form the bag side wall.

In the implementation shown in FIG. 6, a fabric liner is sewn or otherwise coupled to the bag side wall along the first and second edges 510*a*, 510*b* of the bag side wall 510, and the third and fourth edges 510*c*, 510*d* of the bag side wall 510 are coupled to each other but not to the bag 500. This configuration allows the liner to be pulled out of the bag cavity 624 (e.g., for cleaning out the bag or cleaning the liner). However, in other implementations, the bag may not have a separate liner, and the bag side wall is an inner surface of the material that is used for the exterior of the bag.

In addition, in FIG. 6, a hook 622 is coupled to a fixed surface in the bag cavity 624. Keys may be hung from the hook 622. The hook 622 is adjacent the opening of the bag 500 to make it easy to access the keys. The hook 622 may be sewn or otherwise coupled to the liner 614. The hook 622 shown in FIG. 6 is open, but in other implementations, the hook has a latch.

Figure 5:
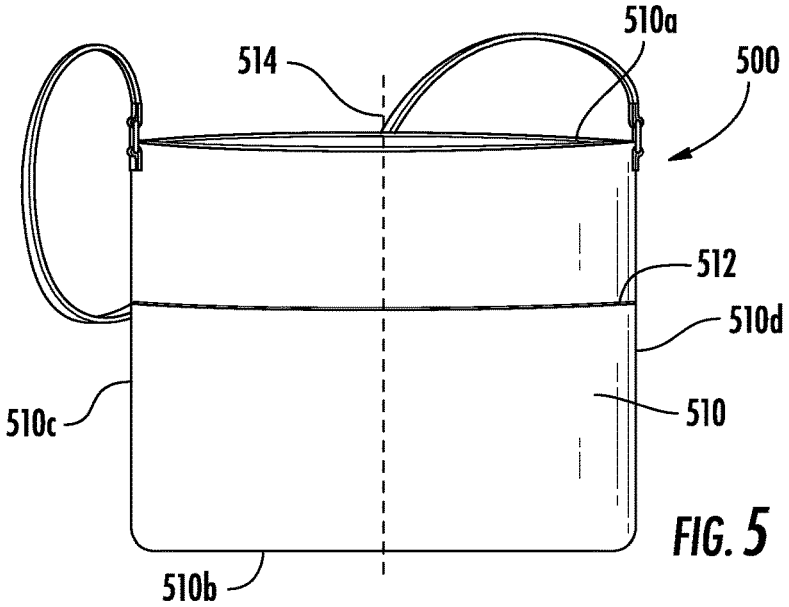
FIG. 5 illustrates a perspective side view of a bag according to another implementation.

Referring to FIGS. 5 and 6, the outer surface of the bag side wall 510 defines an external pocket 512 configured for receiving a smartphone, other mobile electronic device, or any item the user wants to store and retrieve easily. The external pocket 512 shown in FIG. 5 does not include a closure but is configured to lie flat against the bag side wall when not being urged open. In addition, the depth of this pocket 512 may be selected depending on the intended use of the bag, the size of the object(s) intended to be stored within the pocket, and/or the style of the bag.

The main opening of the bag and/or one or more external pockets may be open or include a closure. For example, the closure may be a zipper, at least one magnet, a flap, or a clasp.

The bag side wall may be made from a single piece of material having a rectangular shape, such as is shown in the implementations in FIGS. 1A and 5. The material has first, second, third, and fourth edges 510*a*-510*d*. The first edge 510*a* of the bag side wall material corresponds with the first edge of the bag, the second edge 510*b* of the bag side wall material is opposite and spaced apart from the first edge 510*a* of the bag side wall material, and the third and fourth edges 510*c*, 510*d* of the bag side wall material extend between the first and second edges 510*a*, 510*b* and are opposite and spaced apart from each other. The bag side wall material 510 is folded about an axis 514 that extends through the third and fourth edges 510*c*, 510*d* such that the first and second edges 510*a*, 510*b* define the opening to the bag cavity. The third and fourth edges 510*c*, 510*d* are coupled together to form side seams.

However, in other implementations, such as shown in FIG. 1B, the bag 10 may have multiple side walls formed from separate pieces of material that are sewn or otherwise coupled together alongside and bottom edges thereof to define the bag cavity. And, in other implementations, separate pieces of material form the side walls and these separate pieces are sewn or otherwise coupled to another piece of material that forms the closed end of the bag cavity. In another implementation, the bag side wall may include two pieces of material that are sewn or otherwise coupled together alongside edges and a bottom edge thereof to define the bag cavity. And, in yet another implementation, the bag side wall may include one piece of material that includes third and fourth edges that are sewn or otherwise coupled together along one side seam of the bag. Another piece of material may be sewn or otherwise coupled to the second edge of the material to form the closed end of the bag cavity, or the second edges may be sewn or otherwise coupled together to form the closed end.

In other implementations, a front view of the pocket side wall has a triangular shape when assembled and coupled to the interior surface of the bag. In one such implementation, the pocket side wall is formed from a rectangular shaped material having a first edge and a second edge that are opposite and spaced apart from each other and a third edge and a fourth edge that extend between the first and second edges and are opposite and spaced apart from each other. The second edge is folded toward and coupled with the fourth edge, and the first edge and the third edge define the opening to the pocket cavity.

Similarly, the eyewear pockets described above in relation to FIGS. 2-10 have one side wall, but in other implementations, such as in FIG. 11, the eyewear pocket has multiple side walls formed from separate pieces of material that are sewn or otherwise coupled together along the side and bottom edges thereof to define the eyewear pocket cavity. In other implementations, separate pieces of material form the side walls and these separate pieces are sewn or otherwise coupled to another piece of material that forms the closed end of the eyewear pocket cavity. And, in yet another implementation, the pocket side wall may include one piece of material wherein the third and fourth edges of the material are sewn or otherwise coupled together along one side seam of the pocket. Another piece of material may be sewn or otherwise coupled to the second edge of the material to form the closed end of the pocket cavity, or the second edge of the material may be sewn or otherwise coupled together to form the closed end.

In the above described implementations, the covering material 1006 encapsulates the sheet material 1008, but in other implementations, the covering material may extend over one or more portions of an inner surface of the sheet material that faces the pocket cavity. And, in some implementations, the pocket side wall may not include the covering material, and the sheet material may be coupled to the fixed surface of the bag.

The implementations described above utilize sewing as a fastening mechanism, but other suitable fasteners may be used. For example, other suitable fasteners may include magnets, clasps, rivets, a hook and/or a loop, wire or metal fasteners, hook/loop material, or adhesive.

The pockets and wallet described above may be disposed in other places within the bag according to alternative implementations.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

The invention claimed is:

1. A bag organizer system comprising:

a bag having at least one bag side wall, wherein the at least one bag side wall at least partially defines a bag cavity, and a first edge of the at least one bag side wall at least partially defines an opening to the bag cavity; and at least one pocket disposed within the bag cavity and fixedly coupled to a fixed surface within the bag cavity, the pocket comprising at least one pocket side wall having a first edge and a second edge that is opposite the first edge along a longitudinal axis of the pocket, wherein the at least one pocket side wall at least partially defines a pocket cavity, the first edge of the pocket side wall at least partially defines an opening to the pocket cavity, and the second edge of the pocket side wall at least partially defines a closed end of the pocket cavity, wherein:

the first edge of the pocket side wall is closer to the bag opening than the second edge of the pocket side wall, the pocket is expandable and collapsible, a length of the pocket as measured in the direction of the pocket longitudinal axis is greater than a greatest width and/or depth of the pocket when expanded, wherein the width and depth are measured in directions perpendicular to the longitudinal axis and in the same plane, and wherein the width and depth of the pocket are less than a width and a depth of the bag, respectively, the pocket is coupled to the fixed surface by a single seam extending substantially parallel to the longitudinal axis of the pocket and the closed end of the pocket is not coupled to the fixed surface such that the pocket is hingedly coupled to the fixed surface via the single seam, and the pocket is a first pocket and the bag organizer system comprises a second pocket, the second pocket being coupled to the first pocket, and the second pocket having a length, a width, and a depth that is less than the length, width, and depth of the first pocket, and wherein the opening of the second pocket is adjacent the opening of the first pocket.

2. The bag organizer system of claim 1, wherein the fixed surface is an inner surface of the bag side wall, a liner coupled to the bag side wall, a side seam of a liner coupled to the bag side wall, a surface of a bag divider wall, or a side seam coupling two bag side walls.

3. The bag organizer system of claim 1, wherein the pocket side wall further comprises a sheet material and a covering material that extends over at least an inner surface of the sheet material, the inner surface of the sheet material facing the pocket cavity, the sheet material having a stiffness that is greater than a stiffness of the covering material.

4. The bag organizer system of claim 3, wherein the covering material is fabric, leather, or vinyl.

5. The bag organizer system of claim 3, wherein the sheet material is chosen from foam, felt, interfacing textile, cardboard, polymer, metal, or composites thereof.

6. The bag organizer system of claim 3, wherein the covering material is sewn to the fixed surface of the bag, and the sheet material is encapsulated by the covering material but is not sewn to the fixed surface of the bag.

7. The bag organizer system of claim 6, wherein a portion of the covering material extends past the second edge of the sheet material to form the closed end of the pocket.

8. The bag organizer system of claim 7, wherein the at least one pocket side wall is a single side wall, the single side wall encircles the pocket cavity, and the single seam is formed with a portion of the covering material that extends past a perimeter of the sheet material in a direction perpendicular to the longitudinal axis of the pocket cavity.

9. The bag organizer system of claim 8, wherein:

the single pocket side wall is rectangular shaped and comprises third and fourth edges that extend between the first and second edges of the pocket side wall and are opposite and spaced apart from each other, and the pocket side wall is folded about an axis that extends through the first and second edges of the pocket side wall such that the third and fourth edges are adjacent each other and are coupled together and to the fixed surface of the bag via the single seam.

10. The bag organizer system of claim 9, wherein the covering material is fabric, and the sheet material is rectangular shaped and comprises a score that extends from a center of a first edge of the sheet material to a center of a second edge of sheet material, wherein a first portion of the sheet material is on one side of the score and a second portion of the sheet material is on the other side of the score, and wherein the first and second portions are spaced further apart from each other to define the pocket cavity in an expanded configuration than in a collapsed configuration.

11. The bag organizer system of claim 10, wherein the score is a first score, and the sheet material comprises additional scores that extend from the first edge of the sheet material to the second edge of the sheet material, the sheet material being bendable about the scores for collapsing and expanding.

12. The bag organizer system of claim 11, wherein the scores comprise second, third, and fourth scores that are spaced apart from each other and a third edge of the sheet material in the first portion, and fifth, sixth, and seventh scores that are spaced apart from each other and a fourth edge of the sheet material in the second portion, wherein the third and fourth edges of the sheet material extend between the first and second edges and are opposite and spaced apart from each other.

13. The bag organizer system of claim 1, wherein the single seam of the second pocket is coupled to the single seam of the first pocket and the fixed surface of the bag.

14. The bag organizer system of claim 1, wherein an outer surface of the bag side wall defines a pocket, the bag side wall pocket configured for receiving a smartphone or mobile computing device.

15. The bag organizer system of claim 1, wherein:

the at least one bag side wall comprises a piece of material having a rectangular shape with first, second, third, and fourth edges, the first edge of the bag side wall material corresponds with the first edge of the bag, the second edge of the bag side wall material is opposite and spaced apart from the first edge of the bag material, and the third and fourth edges of the bag side wall material extend between the first and second edges and are opposite and spaced apart from each other, the bag side wall material is folded about an axis that extends between the first and second edges such that the first and second edges define the opening to the bag cavity, and the third and fourth edges are coupled together to form side seams.

16. The bag organizer of claim 1, wherein the at least one pocket side wall comprises a sheet material that extends from the first edge of the pocket side wall to the second edge of the pocket side wall, wherein the sheet material has a stiffness that supports the first edge of the pocket side wall and prevents the first edge of the pocket side wall from collapsing toward or away from the pocket cavity under the force of gravity.

17. The bag organizer system of claim 16, wherein the sheet material is chosen from foam, felt, interfacing textile, polymer, cardboard, metal, or composites thereof.

18. The bag organizer system of claim 16, wherein the at least one pocket side wall is a single side wall that encircles the pocket cavity.

* * * * *